United States Patent [19]

Linder et al.

[11] Patent Number: 4,653,447

[45] Date of Patent: Mar. 31, 1987

[54] ARRANGEMENT FOR CONTROLLING THE QUANTITY OF FUEL TO BE INJECTED INTO AN INTERNAL COMBUSTION ENGINE

[75] Inventors: Ernst Linder, Mühlacker; Helmut Rembold, Stuttgart, both of Fed. Rep. of Germany

[73] Assignee: Robert Bosch GmbH, Stuttgart, Fed. Rep. of Germany

[21] Appl. No.: 742,577

[22] Filed: Jun. 7, 1985

[30] Foreign Application Priority Data

Jul. 20, 1984 [DE] Fed. Rep. of Germany ..... 3426799

[51] Int. Cl.[4] ..... F02D 5/00; F02D 1/18

[52] U.S. Cl. ..... 123/357; 123/458; 123/494

[58] Field of Search ..... 123/357, 358, 359, 493, 123/490, 458, 494

[56] References Cited

U.S. PATENT DOCUMENTS

| | | | |
|---|---|---|---|
| 3,716,035 | 2/1973 | Adler et al. | 123/357 |
| 3,796,197 | 3/1974 | Locher et al. | 123/357 |
| 4,180,026 | 12/1979 | Schulzke et al. | 123/490 |
| 4,279,229 | 7/1981 | Arnold et al. | 123/357 |
| 4,494,507 | 1/1985 | Yasuhara | 123/357 |
| 4,495,915 | 1/1985 | Shinoda et al. | 123/357 |
| 4,509,487 | 4/1985 | Mowbray | 123/357 |
| 4,526,149 | 7/1985 | Hafele et al. | 123/357 |

FOREIGN PATENT DOCUMENTS

| | | | |
|---|---|---|---|
| 3343394 | 5/1984 | Fed. Rep. of Germany | 123/357 |

*Primary Examiner*—Willis R. Wolfe, Jr.
*Attorney, Agent, or Firm*—Walter Ottesen

[57] ABSTRACT

The invention is directed to an arrangement for controlling the quantity of fuel to be injected into an internal combustion engine. The arrangement includes at least one electrically operated control device determining the beginning and/or the end and/or the duration of the injection of fuel into the internal combustion engine. The electrically operated control device is influenced in dependence on its own control response. The arrangement of the invention thus makes it possible to correct the error resulting from variations in the pickup and dropout times of the electrically operated control device. Embodiments are described which take into account static and dynamic variations of the control response of the electrically operated control device.

14 Claims, 5 Drawing Figures

ARRANGEMENT FOR CONTROLLING THE QUANTITY OF FUEL TO BE INJECTED INTO AN INTERNAL COMBUSTION ENGINE

FIELD OF THE INVENTION

The invention relates to an arrangement for controlling the quantity of fuel to be injected into an internal combustion engine. The arrangement includes a pump apparatus for developing the pressure for the injection. The pump apparatus includes an electrically operated control device for determining at least one of the following quantities: injection begin, injection end and duration of injection.

BACKGROUND OF THE INVENTION

It is known to deliver fuel to an internal combustion engine by means of a fuel injection pump. In a known arrangement, the start and the end of the injection of fuel into the internal combustion engine are determined by means of an electrically operated control device. On the condition that the electrically operated control device has a specific known control response, it is possible to select the start and/or the end of the injection on the basis of a desired fuel quantity to be injected such that just the desired amount of fuel is injected into the internal combustion engine.

In the mass production of fuel injection pumps including suitable electrically operated control devices all of the control devices do not have identical operating characteristics. On the contrary, tolerances in the manufacture of the electrically operated control devices result in such substantial variations in the operating response that it is not possible with the known arrangement to supply precisely the desired amount of fuel to the internal combustion engine.

SUMMARY OF THE INVENTION

By contrast, the arrangement of the invention for controlling the amount of fuel to be injected into an internal combustion engine has an advantage over the state-of-the-art referred to in the foregoing in that exactly the desired fuel quantity is supplied to the internal combustion engine. This is accomplished in that at least one of the quantities: start injection, end injection and duration of injection is modified in dependence on the operating response of the electrically operated control device.

It is a particular advantage in this arrangement to consider not only the static, but also the dynamic operating response of the electrically operated control device.

Further advantages of the invention will become apparent from the subsequent description in conjunction with the drawing and from the claims.

BRIEF DESCRIPTION OF THE DRAWING

The invention will now be described with reference to the drawing wherein.

DESCRIPTION OF THE PREFERRED EMBODIMENTS OF THE INVENTION

Figure 1:
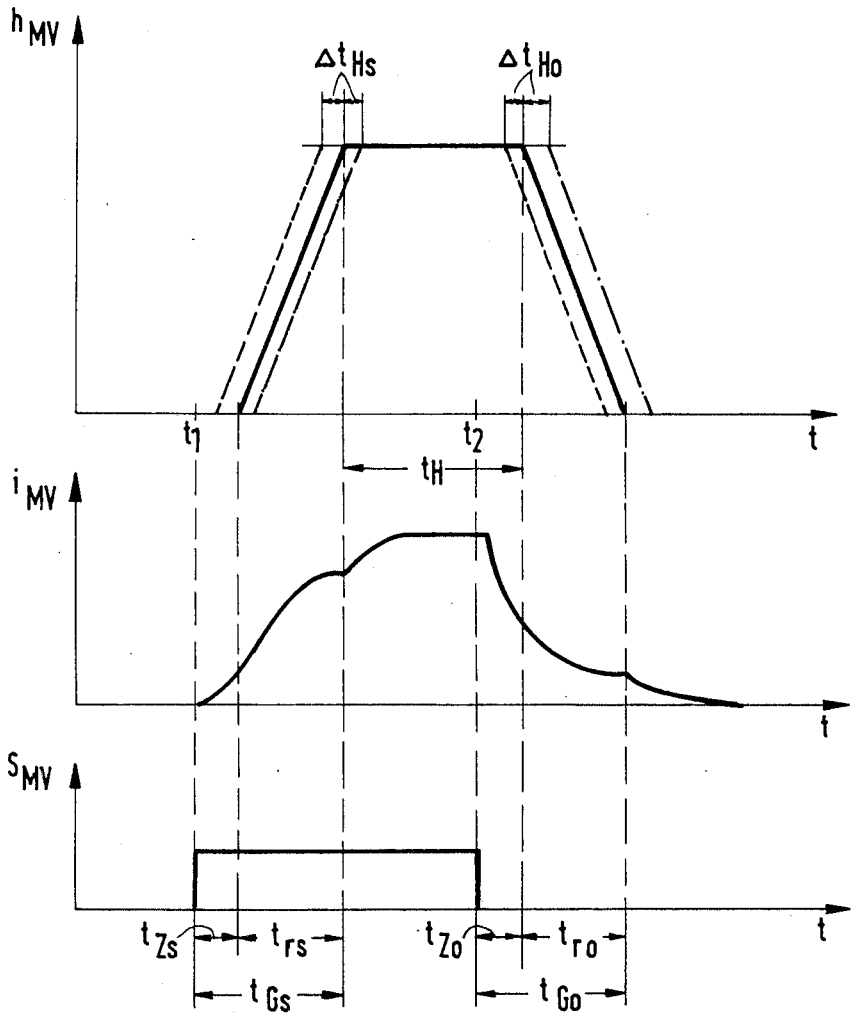
FIG. 1 is a series of three diagrams relating to the static quantity of injected fuel.

Referring now to FIG. 1, the top diagram shows the solenoid valve stroke $h_{MV}$ as it occurs in the presence of a static operating response of a solenoid valve. The center diagram of FIG. 1 shows the solenoid valve current $i_{MV}$, whereas the bottom diagram illustrates the control pulse $S_{MV}$ for actuating the solenoid valve. All three diagrams of FIG. 1 are plotted against time.

Using the control pulse $S_{MV}$ of FIG. 1 as a basis, it can be seen that with the start of pulse $S_{MV}$, current $i_{MV}$ starts to flow through the solenoid valve; whereas, the actual solenoid valve stroke $h_{MV}$ does not commence until a short time later. Since in the diagrams of FIG. 1, by way of example, pulse $S_{MV}$ closes the solenoid valve, the time delay from the beginning of the control pulse to the beginning of the solenoid valve stroke is referred to as the closing delay $t_{Zs}$. The actual pickup time which is the time the solenoid valve requires to move from its open into its closed position is shown in the top diagram of FIG. 1. This time is referred to as the closing time $t_{rs}$. By analogy, the same relationships apply when the solenoid valve opens. The time delay from the end of the control pulse to the dropout of the solenoid valve is referred to as the opening delay $t_{Zo}$. The actual dropout time of the solenoid valve is identified as the opening time $t_{ro}$. From these times the total closing time $t_{Gs}$ is: $t_{Gs}=t_{Zs}+t_{rs}$, and the total opening time is given by: $t_{Go}=t_{Zo}+t_{ro}$. While $t_1$ marks the beginning of control pulse $S_{MV}$, that is, its leading edge, $t_2$ marks the end of control pulse $S_{MV}$, that is, its trailing edge. In the diagrams of FIG. 1, $t_H$ identifies the actual total closed duration of the solenoid valve, that is, the duration of time during which the solenoid valve is in its closed position.

The time delay from the beginning of the pulse at $t_1$ to the beginning of the solenoid valve stroke movement, that is, the closing delay $t_{Zs}$, is attributable to the back pressure acting on the needle of the solenoid valve, which pressure has to be first overcome by the magnetic force built up by the solenoid valve current. When the solenoid valve reaches its closed position after total closing time $t_{Gs}$, a kink or, in mathematical terms, a discontinuity will ensue in the flow of the solenoid valve current $i_{MV}$ because at that time mutual induction is no longer present. By analogy, the time delay from the actual end of the pulse $S_{MV}$ at $t_2$ to the beginning of solenoid valve dropout results from the mechanical conditions in connection with the use of the solenoid valve. When the solenoid valve has reached its final, that is, open state, the ensuing lack of mutual induction will likewise result in a kink or discontinuity in the plot of solenoid valve current $i_{MV}$.

Overall, therefore, the solenoid valve stroke $h_{MV}$, that is, the movement of the needle in the solenoid valve does not correspond exactly to the control pulse $S_{MV}$ because of the occurrence of delay times and pickup and dropout times. However, by means of the solenoid valve current $i_{MV}$, it is possible to precisely determine when the needle in the solenoid valve has reached a defined final state.

Assuming that the amount of fuel to be injected into the internal combustion engine is dependent on the duration of time in which the solenoid valve is closed, it will be seen from the diagrams of FIG. 1 that theoretically a clearly defined relationship results between control pulse $S_{MV}$ via solenoid valve stroke $h_{MV}$ to the amount of fuel to be injected.

It is to be noted, however, that manufacturing tolerances, age, and the like are apt to change the operating response of individual solenoid valves. For example, these changes may affect the pickup or dropout time of the solenoid valve as identified by $\Delta t_{Hs}$ and $\Delta t_{Ho}$ in the upper diagram of FIG. 1. As a result of these deviations of the actual operating response of a solenoid valve from an assumed theoretical operating response, it is no longer possible to establish a defined relationship between control pulse $S_{MV}$ and the amount of fuel to be injected. Accordingly, it is not possible in practice to feed exactly the desired amount of fuel to the internal combustion engine merely by controlling the switch-on time $t_1$ and switch-off time $t_2$ of the pulse.

Figure 2:
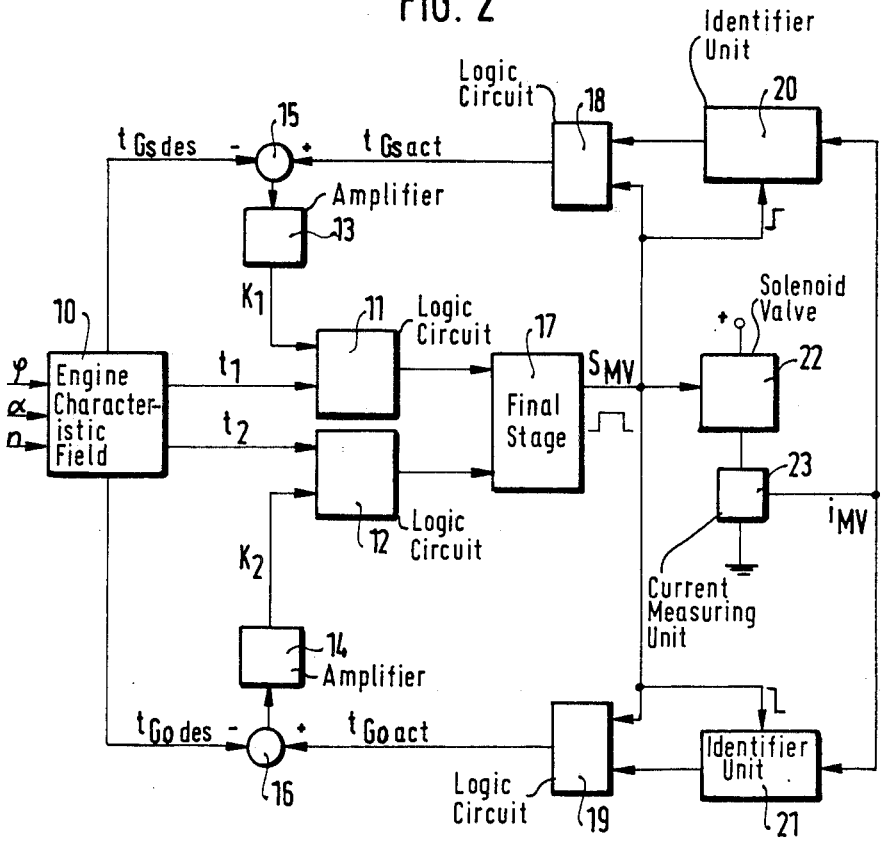
FIG. 2 is a block diagram illustrating a first embodiment according to the invention.

FIG. 2 shows a first embodiment of an arrangement for controlling the amount of fuel to be injected into an internal combustion engine. Reference numeral 10 identifies an engine characteristic field, reference numerals 11 and 12 logic circuits, reference numberals 13 and 14 amplifiers, and reference numerals 15 and 16 summing points. A final stage is identified by reference numeral 17. Reference numerals 18 and 19 identify logic circuits; whereas, reference numerals 20 and 21 denote identifier units. Finally, a solenoid valve and a current measuring unit are identified by reference numerals 22 and 23, respectively.

Input signals indicative of crank angle $\rho$, accelerator pedal position $\alpha$ and engine speed n are applied to engine characteristic field 10. In dependence on these signals, engine characteristic field 10 generates four output signals indicative of the switch-on time point $t_1$ and the switch-off time point $t_2$ of control pulse $S_{MV}$ on the one hand, and on the other hand, two desired values, namely, the total closing time $t_{Gsdes}$ and the total opening time $t_{Godes}$. Signal $t_1$ is conducted to logic circuit 11, signal $t_2$ to logic circuit 12, signal $t_{Gsdes}$ to summing point 15, and signal $t_{Godes}$ to summing point 16.

The output signal of summing point 15 is applied to amplifier 13, while the output signal of summing point 16 is applied to amplifier 14. In dependence on its input signal, amplifier 13 produces an output signal $K_1$; whereas, amplifier 14 generates an output signal $K_2$ likewise dependent on its input signal. In this arrangement, signals $K_1$ and $K_2$ are applied to logic circuits 11 and 12, respectively. Depending on their respective input signals $K_1$, $t_1$ and $K_2$, $t_2$, logic circuits 11 and 12 produce each an output signal that is passed to final stage 17. The output signal of final stage 17 is applied to logic circuits 18 and 19, to identifier units 20 and 21, and to solenoid valve 22.

Solenoid valve 22 is series-connected with current measuring unit 23 and with a positive supply voltage; whereas, the current measuring unit 23 is connected to ground. The output signal of current measuring unit 23, that is, the solenoid valve current $i_{MV}$, is conducted to the two identifier units 20 and 21. The output signals of identifier units 20 and 21 go to logic circuits 18 and 19 which, in dependence on their input signals, generate each an output signal that is applied to summing points 15 and 16, respectively. In this arrangement, logic circuit 18 generates the signal of the actual total closing time $t_{Gsact}$ and logic circuit 19 provides the signal of the actual total opening time $t_{Goact}$.

The output signal of final stage 17 is the control pulse $S_{MV}$ which activates or deactivates the solenoid valve 22. While the leading edge of this control pulse is detected by identifier unit 20, identifier unit 21 is adapted to respond to its trailing edge. Logic circuits 11 and 12 may be differential amplifiers, for example; whereas, integrators or counters, for example, may be used for logic circuits 18 and 19.

Solenoid valve 22 is controlled by pulse $S_{MV}$. This means that during the time that the control pulse $S_{MV}$ is applied, a current flows from the positive supply voltage via solenoid valve 22 to current measuring unit 23. At the same time, control pulse $S_{MV}$ also acts on the two identifier units 20 and 21, such that the pulse leading edge activates identifier unit 20 while the pulse trailing edge activates identifier unit 21. As a result of the activation of identifier units 20 or 21, the responding identifier unit detects the kink or discontinuity in the characteristic of the flow of current $i_{MV}$ and supplies a corresponding output signal to the follow-on logic circuit 18 or 19. Thus, since control pulse $S_{MV}$ is also applied to the two logic circuits 18 and 19, these circuits can generate corresponding output signals in dependence on their inputs. For example, logic circuit 18 receives as an input signal the leading edge of control pulse $S_{MV}$ and, from identifier 20, the logic circuit 18 receives as an input signal a signal indicative of the time that the first kink or discontinuity has occurred in the flow of current $i_{MV}$, as shown in the center diagram of FIG. 1. Dependent on these two input signals, logic circuit 18 generates an output signal corresponding to the actual total closing time $t_{Gs}$. Summing point 15 compares the actual total closing time signal $t_{Gsact}$ with the desired total closing time signal $t_{Gsdes}$. The result of this comparison is evaluated in amplifier 13 producing output signal $K_1$ which is conducted to logic circuit 11.

For a continuous control it is particularly advantageous to use, for example, the amplifier 13 for the intermediate storage of the amplifier output signal, that is, the value of signal $K_1$. The desired total closing time $t_{Gsdes}$ as well as the second input signal of logic circuit 11, which is the switch-on time point of the pulse at $t_1$, are generated by engine characteristic field 10 in dependence on at least one of the following quantities: crank angle $\rho$, accelerator pedal position $\alpha$ and engine speed n.

Logic circuit 11 finally generates, in dependence on its two input signals, an output signal which is applied to final stage 17 and defines the actual beginning of the pulse, that is, the actual leading edge of control pulse $S_{MV}$. Accordingly, starting from solenoid valve 22 and continuing via current measuring unit 23, identifier unit 20, logic circuit 18, summing point 15, amplifier 13, logic circuit 11 and final stage 17, a closed loop control system is established by means of which control pulse $S_{MV}$ acts on solenoid valve 22 such that the actual closing action of the solenoid valve corresponds to a predetermined desired response. By analogy, a corresponding second closed loop control system is obtained by means of elements 22, 23, 21, 19, 16, 14, 12 and 17 to control the opening response of solenoid valve 22.

With the amount of fuel to be injected into an internal combustion engine controlled by means of solenoid valve 22, the first embodiment of FIG. 2 enables the different control responses of different solenoid valves to be modified such that the direct relationship between the control pulse applied to the solenoid valve and the resulting fuel quantity to be injected can be utilized for the accurate metering of fuel into the internal combustion engine. In this arrangement, for example, a specific known solenoid valve may serve as model for the values stored in engine characteristic field 10 as well as for the dependence of signals $K_1$ and $K_2$ on the input signals of amplifiers 13 and 14. However, it is also possible to use a theoretical average response of the solenoid valve utilized as the basis for the generation of the above-stated values and signals.

By means of the arrangement described above, it is thus possible to correct variations in the quantities injected which may occur as a result of a delayed switching response of a solenoid valve. Until now it has been assumed that the closing and opening speeds of the solenoid valve are constant, that is, that the delays mentioned result only from different closing and opening delays $t_{Zs}$ and $t_{Zo}$, respectively. In addition, the closing time and opening time $t_{rs}$ and $t_{ro}$, respectively, may also vary, or the case may occur that only these two last-mentioned times vary. It is also possible that the opening speed and closing speed of the solenoid valve are variable. In this case, however, the quantity of fuel injected depends also on the speed of the solenoid valve and requires appropriate correction.

Figure 3:
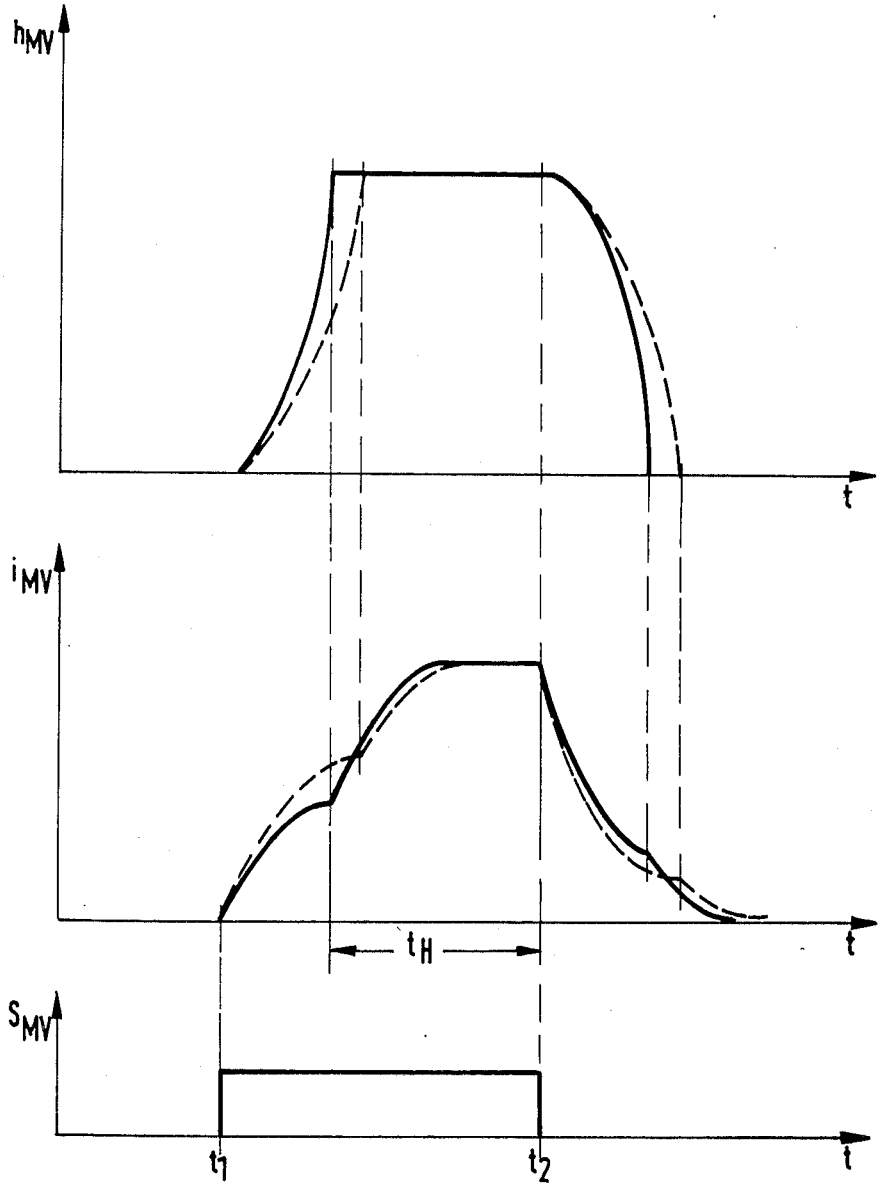
FIG. 3 is a series of three diagrams relating to the dynamic quantity of injected fuel.

FIG. 3 shows diagrams relating to the dynamic quantity of injected fuel. The three diagrams of FIG. 3 correspond to the diagrams of FIG. 1. In FIG. 3, however, the solenoid valve opening time and closing time is not constant but variable. Therefore, the diagrams of FIG. 3 consider the dynamic properties of the solenoid valve, that is, its variable closing and opening speeds, and the dynamic changes in the amount of fuel to be injected resulting therefrom.

Figure 4:
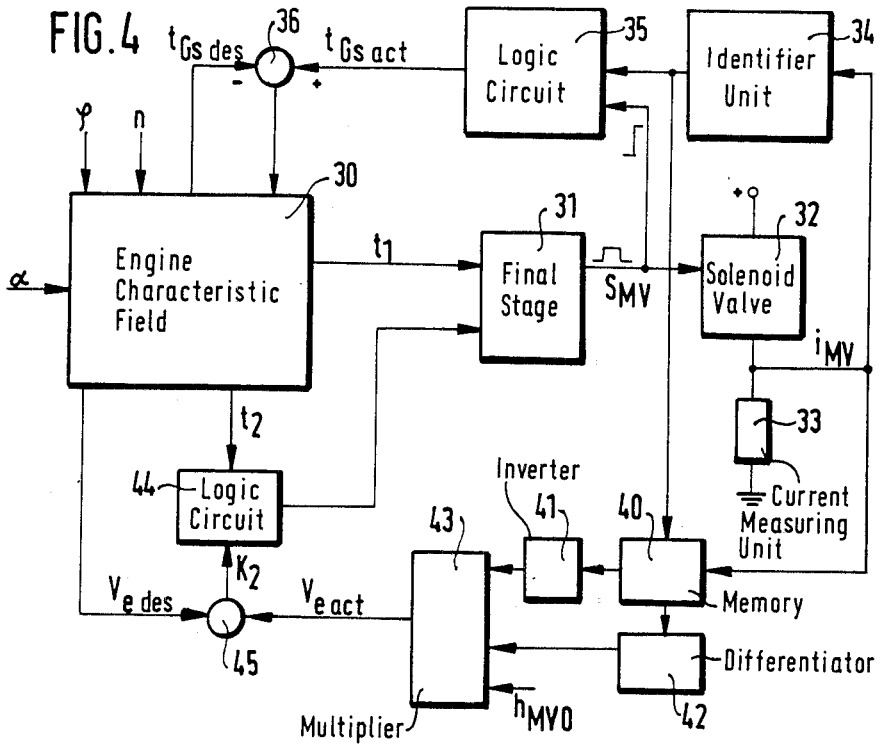
FIG. 4 is a block diagram illustrating a second embodiment according to the invention; and, FIG. 5 is a block diagram of a third embodiment according to the invention.
Figure 5:
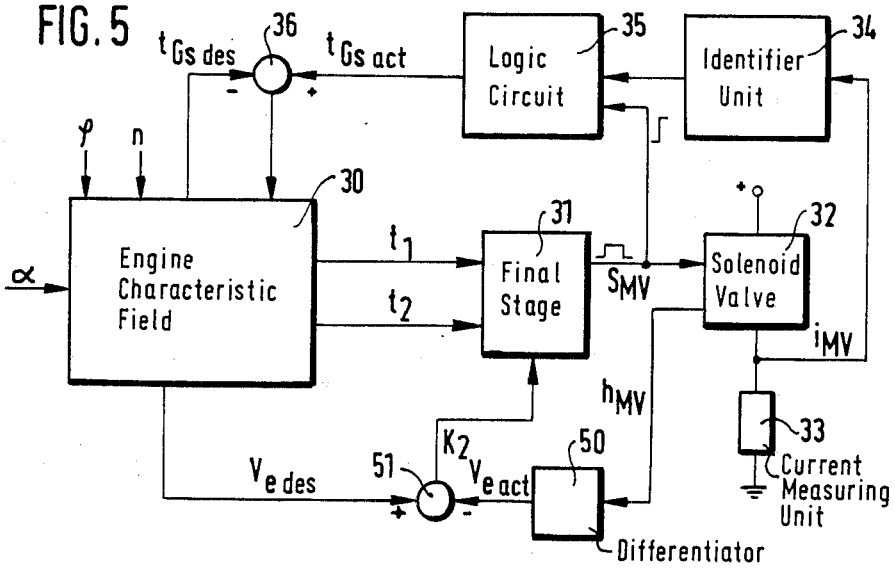

FIG. 4 is a second embodiment and FIG. 5 is a third embodiment in connection with the dynamic correction of the injected quantity. In FIGS. 4 and 5, reference numeral 30 identifies an engine characteristic field, reference numeral 31 a final stage, the solenoid valve is assigned reference numeral 32, a current measuring unit reference numeral 33, an identifier unit reference numeral 34, a logic circuit reference numeral 35, and a summing point with reference numeral 36.

The engine characteristic field 30 of FIGS. 4 and 5 has applied to its input at least one of the following three quantities: crank angle $\rho$, accelerator pedal position $\alpha$ and engine speed n. Another input signal applied to engine characteristic field 30 is the output signal of summing point 36. In dependence on these input signals, engine characteristic field 30 generates a total of four output signals, that is, the switch-on time point $t_1$ of control pulse $S_{MV}$, the switch-off time point $t_2$ of the control pulse, the desired total closing time $t_{Gsdes}$, and a desired valve needle speed $v_{edes}$.

In FIGS. 4 and 5, signal $t_1$ is conducted to final stage 31 which, in turn, produces control pulse $S_{MV}$ as an output signal which is applied to solenoid valve 32 and logic circuit 35. Solenoid valve 32 is connected in series with current measuring unit 33, with the free end of the solenoid valve being connected to a positive battery voltage and the free end of the current measuring unit 33 being connected to ground. From the circuit connection between solenoid valve 32 and current measuring unit 33, a line branches off to identifier unit 34 which provides a signal indicative of the solenoid valve current $i_{MV}$. The output signal of identifier unit 34 is applied to logic circuit 35 as a second input signal. The output signal of logic circuit 35 as well as the signal $t_{Gsdes}$ produced by engine characteristic field 30 are applied to the inputs of summing point 36. As stated in the foregoing, the output of summing point 36 is passed to engine characteristic field 30.

The explanations given up to this point apply identically to the two embodiments of FIGS. 4 and 5. Their mode of operation corresponds basically to the mode of operation of the first embodiment of FIG. 2. By contrast with the embodiment of FIG. 2, however, the two embodiments of FIGS. 4 and 5 provide for incorporation of logic circuit 11 and amplifier 13 into the engine characteristic field 30 which means that the correction of the switch-on time point $t_1$ of the pulse is transferred directly to the engine characteristic field.

In the embodiment of FIG. 4, a memory is identified by reference numeral 40, an inverter by 41, a differentiator by 42, and a multiplier by reference numeral 43. Reference numerals 44 and 45 identify a logic circuit and a summing point, respectively. The switch-off time point $t_2$ from engine characteristic field 30 and the output signal $K_2$ from summing point 45 are applied to logic circuit 44. The output signal of logic circuit 44 is conducted to final stage 31. Summing point 45 receives the valve needle desired speed $v_{edes}$ from engine characteristic field 30 as well as the output signal of multiplier 43, which is the valve needle actual speed $v_{eact}$. Memory 40 is connected to the circuit node between solenoid valve 32 and current measuring unit 33, that is, it receives a signal indicative of the solenoid valve current $i_{MV}$. Memory 40 is triggered by the output signal of identifier unit 34, that is, by the point in time of the occurrence of the kink or discontinuity in the characteristic of the flow of solenoid valve current $i_{MV}$ of FIG. 3. Inverter 41 and differentiator 42 are connected to memory 40. The output signals of inverter 41 and of differentiator 42 are conducted to multiplier 43. Another input applied to multiplier 43 is signal $h_{MVO}$.

By contrast with the first embodiment of FIG. 2 in which the switch-off time point $t_2$ of the pulse is influenced in dependence on the difference between desired and actual total opening time, the second embodiment provides for a modification of the switch-off time point $t_2$ with the aid of the difference between desired and actual speeds of the valve needle. This modification is accomplished by means of logic circuit 44 which combines the switch-off time point $t_2$ and correction valve $K_2$ with each other and supplies the result of this logic operation to final stage 31. The valve needle actual speed $v_{eact}$ is generated by means of multiplier 43. Experiments and tests have shown that the following relation approximately applies for the actual speed of the valve needle:

$$v_{eact} = h_{MV}(t) \cdot 1/i_{MV} \cdot di_{MV}/dt$$

Since in the embodiment of FIG. 4 the solenoid valve stroke $h_{MV}(t)$ is unknown, another quantity has to be substituted therefor. Memory 40 is triggered by the output signal of identifier unit 34, so that a new value of solenoid valve current $i_{MV}$ is transferred into the memory whenever the solenoid valve is closed. For this reason, a constant value can be substituted for the solenoid valve stroke $h_{MV}(t)$. This is possible because at the closing point in time of the solenoid valve, the solenoid valve stroke is invariably the same and can be determined empirically. In the embodiment of FIG. 4, this constant solenoid valve stroke is identified by $h_{MVO}$. Accordingly, the above equation is realized by blocks 40 to 43 of FIG. 4 and the valve needle actual speed $v_{eact}$ is generated.

Referring now to FIG. 5, the third embodiment, a differentiator is identified by reference numeral 50 and a summing point by reference numeral 51. In the embodiment of FIG. 5, it is possible to measure the solenoid valve stroke $h_{MV}$ directly at solenoid valve 32. This solenoid valve stroke is applied to differentiator 50. Dependent thereon, differentiator 50 produces an output signal in the form of the valve needle actual speed $v_{eact}$ which is then applied to summing point 51. The summing point 51 is also connected to engine characteristic field 30. In this arrangement, the output signal of summing point 51 is conducted directly to final stage 31.

The solenoid valve stroke $h_{MV}$ is derived by means of differentiator 50, resulting in a signal indicative of the valve needle actual speed at the differentiator output. This output signal is compared with the valve needle desired speed $v_{edes}$ provided by engine characteristic field 30 and, the correction factor $K_2$ is formed in dependence upon this comparison. Correction factor $K_2$ is then used to influence the switch-off time point $t_2$ of control pulse $S_{MV}$ directly in the final stage 31. By contrast with the embodiment of FIG. 4, the embodiment of FIG. 5 thus includes the logic circuit 44 directly in the final stage 31.

In the two embodiments of FIGS. 4 and 5, therefore, the dynamic action of the solenoid valve is taken into account by modifying of the switch-off time point in dependence upon the actual speed of the valve needle. It is to be noted that in the two embodiments of FIGS. 4 and 5, the current measuring unit 33 can be a resistor, logic circuit 35 can be an integrator or counter, and logic circuit 44 can be a differential amplifier, for example.

It is to be understood that the three embodiments of FIGS. 2, 4 and 5 may be combined and/or exchanged in any desired manner. It is to be understood further that simplifications and/or modifications of the embodiments described are also possible. Of importance is the basic concept of the invention, namely, that at least the switch-on time point and/or the switch-off time point of the solenoid valve is influenced in dependence upon the control response of the solenoid valve.

Also, it is irrelevant in which connection the arrangement of the invention is utilized, whether in diesel, gasoline or other internal combustion engines. Moreover, the arrangement of the invention is not limited to the embodiments described but the invention may also be practiced using a suitably programmed electronic computer.

The foregoing description is that of the preferred embodiments of the invention and various changes and modifications may be made thereto without departing from the spirit and scope of the invention as defined in the appended claims.

What is claimed is:

1. Arrangement for controlling the quantity of fuel to be injected into an internal combustion engine for which a pump apparatus generates the pressure for injecting the fuel, the arrangement comprising:

at least one electrically operated control device for determining at least one of the quantities of injection begin, injection end and injection duration, said control device having an operating response;

adjusting circuit means for adjusting one of said quantites in dependence upon said operating response; and, said control device being switchable between an open position and a closed position and having a total closed duration, said adjusting circuit means including means for adjusting at least one of said quantities in dependence upon said total closed duration of said control device.

2. Arrangement for controlling the quantity of fuel to be injected into an internal combustion engine for which a pump apparatus generates the pressure for injecting the fuel, the arrangement comprising:

at least one electrically operated control device for determining at least one of the quantities of injection begin, injection end and injection duration, said control device having an operating response;

adjusting circuit means for adjusting one of said quantities in dependence upon said operating response; and, said control device being switchable between an open position and a closed position and having a total opened duration, said adjusting circuit means including means for adjusting at least one of said quantities in dependence upon said total opened duration.

3. Arrangement for controlling the quantity of fuel to be injected into an internal combustion engine for which a pump apparatus generates the pressure for injecting the fuel, the arrangement comprising:

at least one electrically operated control device for determining at least one of the quantities of injection begin, injection end and injection duration, said control device having an operating response;

adjusting circuit means for adjusting one of said quantities in dependence upon said operating response; and, means for applying a theoretical operating response of said control device to form desired values.

4. Arrangement for controlling the quantity of fuel to be injected into an internal combustion engine for which a pump apparatus generates the pressure for injecting the fuel to the engine, the arrangement comprising:

at least one electrically operated solenoid valve for determining at least one of the quantities of injection begin, injection end and injection duration, said solenoid valve having an operating response;

adjusting circuit means for adjusting one of said quantities in dependence upon said operating response; and, means for applying a current pulse of a predetermined duration to said solenoid valve, said duration being determined empirically by conducting tests on a plurality of said solenoid valves.

5. Arrangement for controlling the quantity of fuel to be injected into an internal combustion engine for which a pump apparatus generates the pressure for injecting the fuel, the arrangement comprising:

at least one electrically operated control device for determining at least one of the quantities of injection begin, injection end and injection duration, said control device having an operating response;

adjusting circuit means for adjusting one of said quantities in dependence upon said operating response; and, said control device having a predetermined opening speed, said adjusting means including means for adjusting at least one of said quantities in dependence upon said opening speed.

6. The arrangement of claim 5, at least one of said quantities being adjusted only when said control device is in a predetermined condition.

7. The arrangement of claim 6, said predetermined condition being selected from the group consisting of a fully closed condition and a fully opened condition.

8. Arrangement for controlling the quantity of fuel to be injected into an internal combustion engine for which a pump apparatus generates the pressure for injecting the fuel, the arrangement comprising:

at least one electrically operated control device for determining at least one of the quantities of injection begin, injection end and injection duration, said control device having an operating response;

adjusting circuit means for adjusting one of said quantities in dependence upon said operating response;

a special electrically operated control device having an operating response; and, means for forming desired values from said operating response of said special electrically operated control device.

9. The arrangement of claim 8, wherein said desired values are formed with the aid of said operating response of said special electrically operated control device for at least one of the following quantities of the control device: total closed duration, total opened duration, the closing speed and the opening speed.

10. The arrangement of claim 8, wherein the entire time characteristic of said operating response of said special electrically operated control device is used as a desired response.

11. Arrangement for controlling the quantity of fuel to be injected into an internal combustion engine for which a pump apparatus generates the pressure for injecting the fuel, the arrangement comprising:

at least one electrically operated control device for determining at least one of the quantities of injection begin, injection end and injection duration, said control device having an operating response;

adjusting circuit means for adjusting one of said quantities in dependence upon said operating response; and, said control device having a predetermined closing speed, said adjusting means including means for adjusting at least one of said quantities in dependence upon said closing speed.

12. The arrangement of claim 11, wherein at least one of said quantities is adjusted during the duration of the movement of said control device.

13. The arrangement of claim 11, at least one of said quantities being adjusted only when said control device is in a predetermined condition.

14. The arrangement of claim 13, said predetermined condition being selected from the group consisting of a fully closed condition and a fully opened condition.

* * * * *